United States Patent [19]

Seklecki

[11] Patent Number: 4,634,125

[45] Date of Patent: Jan. 6, 1987

[54] DEVICE AND METHOD FOR EXCHANGE OF TRADING CARDS AND DICE

[76] Inventor: Sigmund F. Seklecki, 2977 Edgemont St., Philadelphia, Pa. 19134

[21] Appl. No.: 673,982

[22] Filed: Nov. 21, 1984

[51] Int. Cl.[4] ..... A63F 1/00; A63F 1/10

[52] U.S. Cl. ..... 273/93 R; 273/146; 273/148 A; 273/93 C; 211/50

[58] Field of Search ..... 273/148 A, 93 R, 93 C, 273/94, 146; 211/50–54.1

[56] References Cited

U.S. PATENT DOCUMENTS

| | | | |
|---|---|---|---|
| 726,062 | 4/1903 | Honeck | 273/93 R |
| 1,026,188 | 5/1912 | Watts | 273/93 R |
| 1,527,937 | 2/1925 | Tienken | 273/93 R UX |
| 1,536,639 | 5/1925 | Van Beek | 273/93 R |
| 2,245,830 | 6/1941 | Sheffield | 273/94 R |
| 2,740,632 | 4/1956 | Balmer | 273/148 A |
| 3,185,482 | 5/1965 | Russell | 273/148 A |
| 4,244,571 | 1/1981 | Haglof | 273/93 R |
| 4,298,200 | 11/1981 | Kanbar | 273/148 A X |
| 4,377,285 | 3/1983 | Kadlic | 273/148 A |

FOREIGN PATENT DOCUMENTS

| | | | |
|---|---|---|---|
| 1538426 | 1/1979 | United Kingdom | 273/146 |

*Primary Examiner*—Paul E. Shapiro
*Attorney, Agent, or Firm*—Alexis Barron

[57] ABSTRACT

An article for storing and dispensing trading cards including a base member having a card storage compartment defined by a base, two upright side walls, an upright end wall, and a partition, a card dispensing tray which includes a base wall and which is associated with the base member and which is movable relative thereto to a closed position and to a play position, a support associated with the base member for supporting the base wall of the tray when it is in said play position, the support and the base wall being inclined downwardly with respect to the base member, the tray in said play position having an upstanding wall which is capable of supporting a stack of cards positioned on the inclined base wall, and an arcuately shaped, cut-out portion positioned between the base wall and the upstanding wall and from which a card can be dispensed, and a method by which players can acquire trading cards from each other and in which said article can be used, and utilizing also the roll of dice, and including also dispensing cards from the tray of said article to a player or to a common pot for subsequent acquisition by a player, depending on the indicia on the dice.

9 Claims, 8 Drawing Figures

FIGURE 4-A

DEVICE AND METHOD FOR EXCHANGE OF TRADING CARDS AND DICE

FIELD OF THE INVENTION

This invention relates generally to an article for storing and dispensing trading cards, dice having indicia marked with baseball game plays, and a method by which trading card collectors can acquire cards from each other using the article, dice, and a scoreboard.

Trading cards are bought and sold as collectibles. The best known trading cards are those displaying pictures and biographical sketches of sports figures, such as baseball players.

The cards are often issued as a set comprising a large number of different, but related cards which are sold most commonly in packs of one or a few cards each. Usually, the identity of most, if not all, of the cards in the pack is unknown until the pack is purchased. As a result, collectors buying packs of trading cards frequently obtain unwanted cards or duplicates of cards purchased previously.

Such collectors would like to use their unwanted and duplicate cards in acquiring cards which they desire from other collectors. It is of interest to the collectors to have a method that accomplishes this objective in an entertaining manner. In addition, many collectors like to store their trading cards in a location where the cards are available for immediate use in the acquisition of other cards.

REPORTED DEVELOPMENTS

It is known to use a set of dice having baseball markings in a game apparatus simulating baseball.

U.S. Pat. No. 4,244,571 to Haglof discloses a game apparatus comprising two dice having baseball markings, a scoresheet, and a game board containing a representation of a baseball diamond, a playing field and a scoreboard. Each die is marked with different combinations of four of the following game plays: out, single, single plus, double, triple, and home run.

The lowest game play shown on either of the two dice is followed (out over single, etc.), except that when one die shows single plus, the play shown on the other die is followed. The game is played for nine three-out innings as in baseball.

OBJECTS OF THE INVENTION

It is an object of the invention to provide an article that is adapted particularly for the storage and dispensing of trading cards.

It is a further object to provide a method by which collectors can acquire trading cards from each other using the article, a set of dice containing indicia denoting baseball plays, and a scoreboard.

Additional objects and advantages of the invention will be more readily apparent from the following description thereof when considered in conjunction with the accompanying drawings.

SUMMARY OF THE INVENTION

The invention relates generally to an article for storing and dispensing trading cards, to dice having indicia marked with baseball game plays, and to a method by which collectors can acquire trading cards from each other using the article alone and in combination with the dice, the dice and scoreboard, and substitutes for the dice.

The article for storing and dispensing cards comprises:

(A) A base member which includes a card storage compartment and a support element for supporting a card dispensing tray; and (B) a card dispensing tray which is movable relative to the base member to a closed position in which cards in the card storage compartment are covered by the dispensing tray and to a play position in which the tray is supported on the support element of the base member. In preferred form, the card dispensing tray is hinged to the base member and includes walls for supporting a stack of cards, one of said walls comprising a base wall on which the stack of cards rests when the tray is in the play position and which functions as a cover for the storage compartment when the tray is in the closed position. Accordingly, the storage compartment is adapted to hold a supply of cards which can be removed therefrom when the card dispensing tray is moved to the play position and transferred to the base wall of the tray from which they can be dispensed as a game of chance is played as described in detail below.

The invention comprises also a set of three dice, with the six faces of each die marked with identical combinations of indicia representing baseball game plays and coded to enable each die to be readily identified from and read in sequence with the other two dice. The dice can be used in determining the number of trading cards dispensed and to whom the cards are dispensed. Illustrations of how the dice can be used and of various methods of distributing the dispensed cards are given in the Examples section below.

In addition, the present invention can be used with a scoreboard featuring a baseball diamond, and means of indicating runners on base, runs scored, and outs made by each of the players during a baseball inning and the runs scored during each inning of a game. The scoreboard can be used to keep track of the results obtained with the dice.

BRIEF DESCRIPTION OF THE DRAWINGS

FIG. 4-A is a side view of the end wall of the card dispensing tray in the play position.

DETAILED DESCRIPTION OF THE INVENTION

Figure 1:
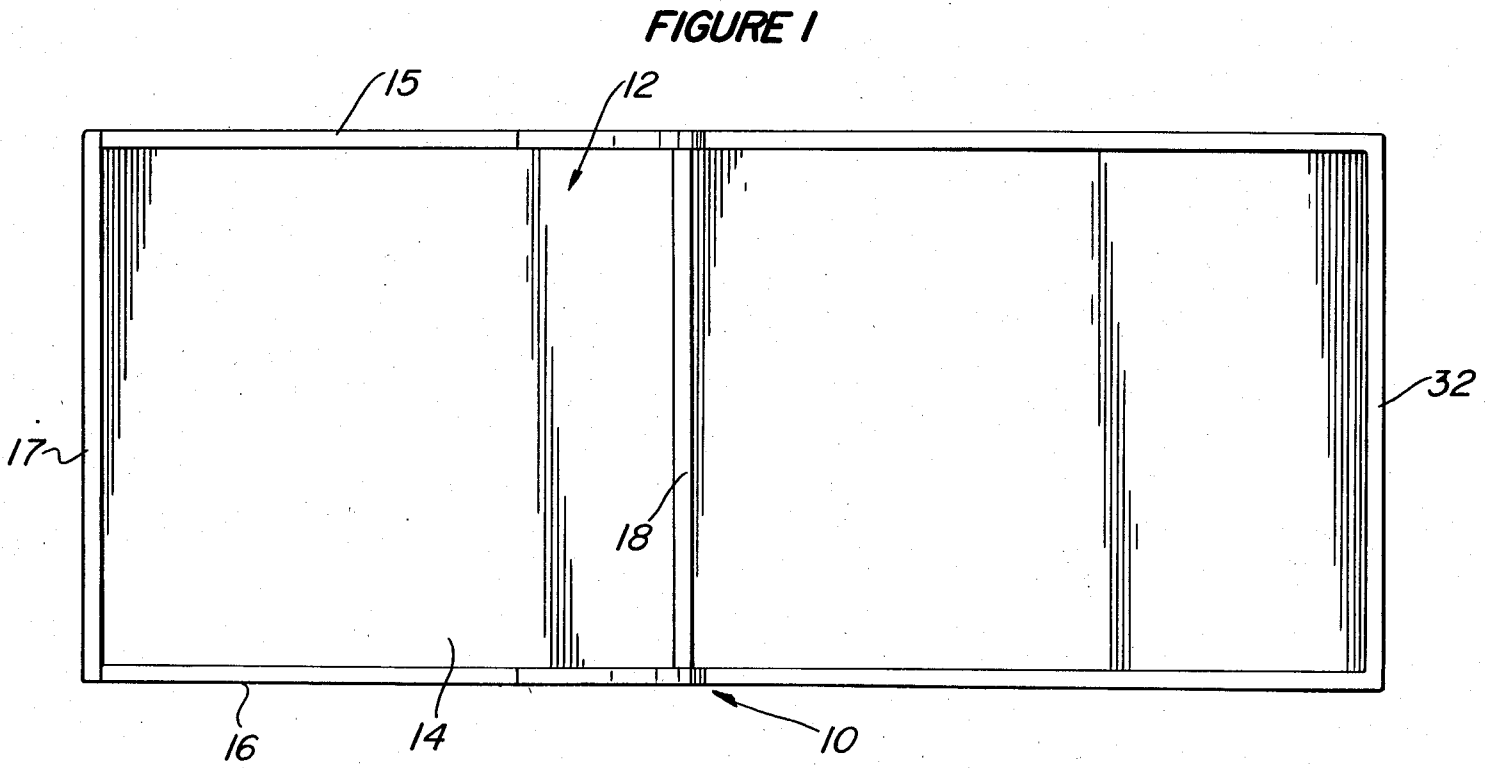
FIG. 1 is a plan view of the base member of the present invention.

The article 1 for storing and dispensing trading cards comprises a base member 10 which includes a card storage compartment 12 for the storage of collectible cards such as baseball cards not shown. The compartment 12 is defined by a base 14, two upright side walls 15 and 16, an upright end wall 17 and partition 18, the latter preferably being shorter in height than the other of said walls. Each of said walls extends from base 14. The dimensions of the compartment are sufficiently large to accommodate collectible cards, for example, baseball trading cards $2\frac{1}{2}'' \times 3\frac{1}{2}''$, including, for example, a $1\frac{1}{2}$–$2\frac{1}{2}''$ stack thereof.

Figure 3:
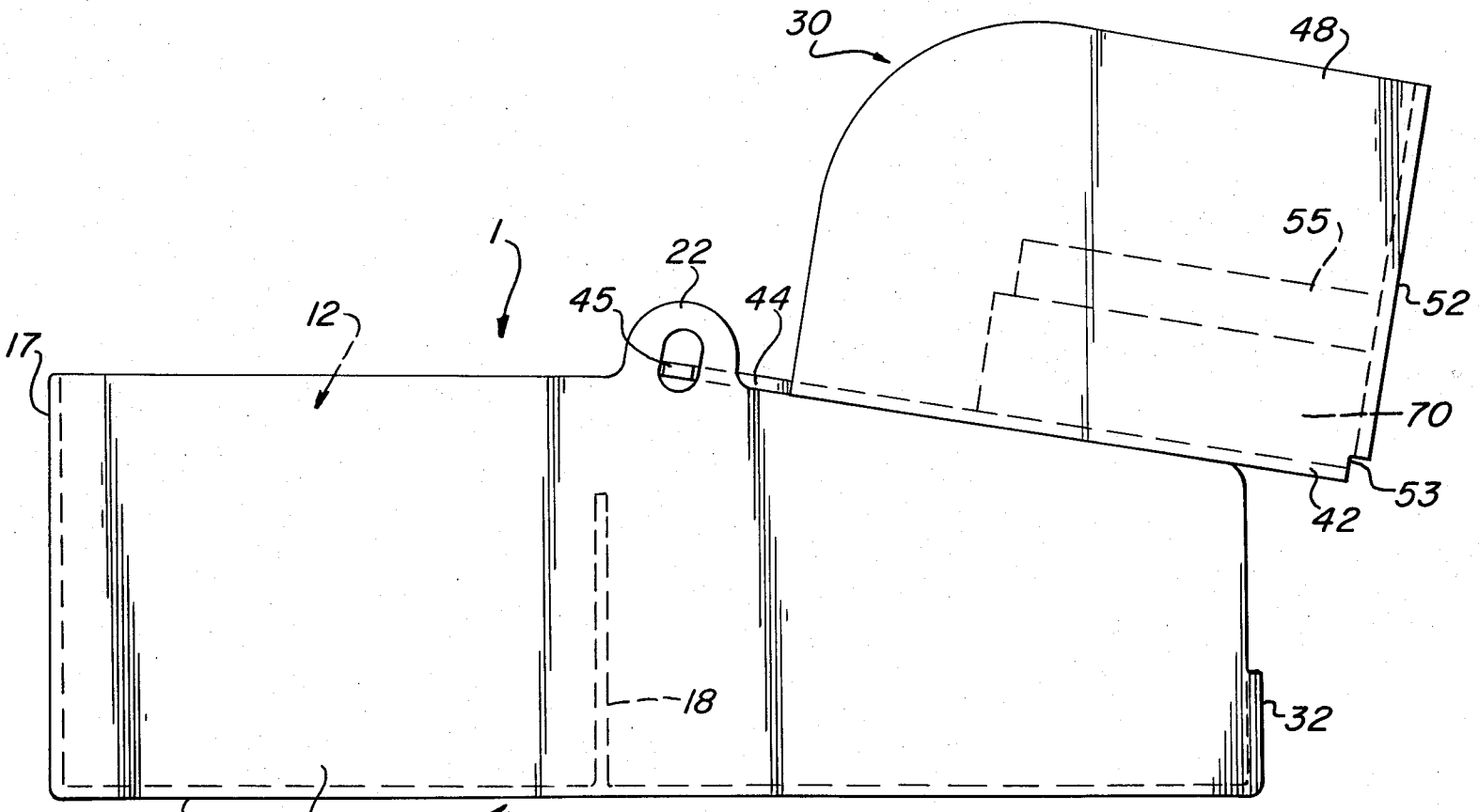
FIG. 3 is a side view of the base member and the card dispensing tray in the play position.

The top of side wall 16 is provided with a hinge-receiving member 22, as is the top of side wall 15, for receiving card dispensing tray 30, as will be described below. The top portion of each of side walls 16 and 15 which extend respectively between hinge-receiving member 22 associated with side wall 16 and the counterpart hinge-receiving member (not shown) associated with side wall 15 and end wall 32 are inclined downwardly with respect to base 14, and function as a support element for tray 30 in the play position, as shown in FIG. 3. End wall 32 extends from base 14 and is shorter in height than the end portions of side walls 15 and 16 which are adjoined thereto.

With reference to the card dispensing tray 30, it includes a base wall 42 which has a width slightly larger than the width of base 14. Base wall 42 has at one end thereof a neck portion 44 which has a smaller width than that of the base wall 42 from which it extends and which includes hinge-engaging members 45 and 46 in the form of nibs for pivoting engagement respectively with the hinge-receiving member 22 and its counterpart member which is associated with side wall 15.

Figure 4:
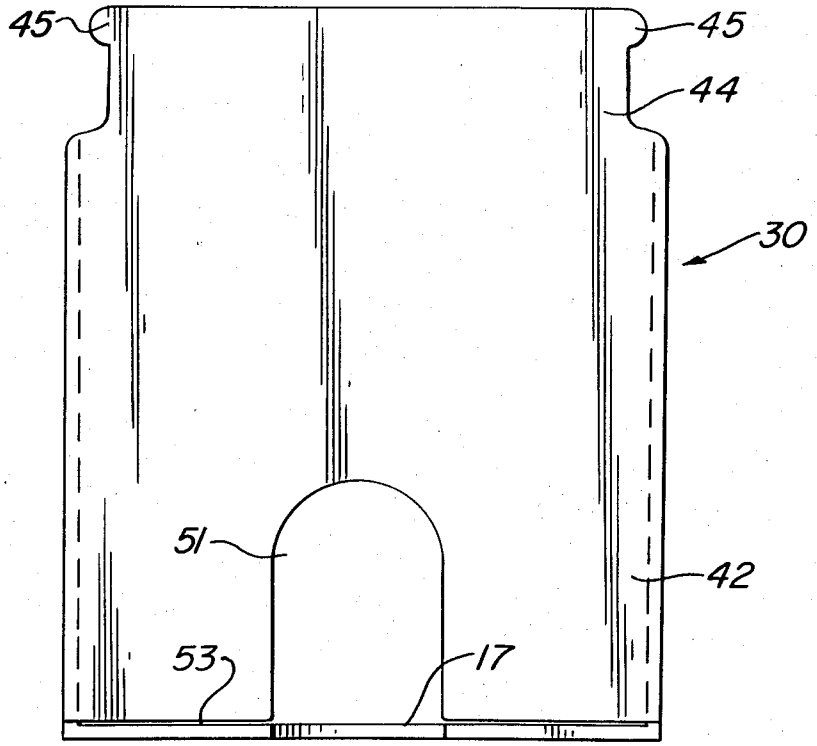
FIG. 4 is a plan view of the card dispensing tray in the closed position.

The other end of base wall 42 is provided with a cut-out portion 51 which is shaped like the end of a finger for providing finger-access to the bottom card of a stack of cards 70 which may be positioned on base wall 42 when tray 30 is in the play position, as shown in FIG. 3. In the play position, the card dispensing tray includes upstanding side walls 48 and 49 and end wall 52 against which card stack 70 leans as a result of the inclined position of base wall 42 when tray 30 is in the play position. End wall 52 terminates short of base wall 42 to provide a slot 53 through which the bottom card of card stack 70 may be dispensed by a player's finger which has access to said card via cut-out portion 51. To facilitate dispensing of the cards, end wall 52 is provided preferably with an arcuately shaped cut-out portion 54, as seen in FIG. 4-A. Finger access to the card stack 70 is provided also by the finger-access space defined by the bottom of base wall 42 and the top of end wall 32 of base member 10. In preferred form, a cover 55 is placed on top of card stack 70 to facilitate frictional finger contact with the bottom card of the stack 70 and to hide the identity of the top card of the stack.

Figure 2:
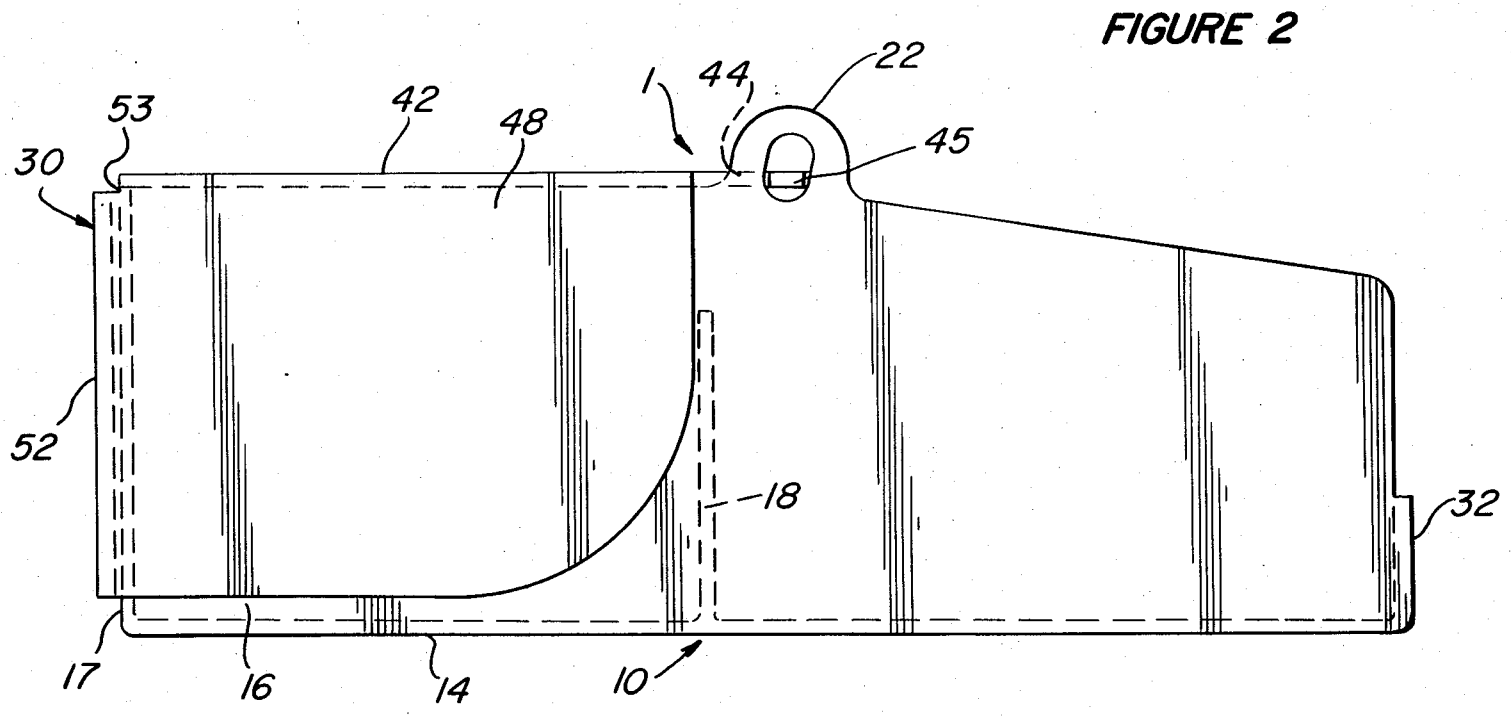
FIG. 2 is a side view of the base member and the card dispensing tray in the closed position.

FIG. 2 shows card dispensing tray 30 in the closed position with the walls thereof shown overlapping the walls of base member 10. Moving tray 30 from the closed to the play position and back to the closed position is readily accomplished manually by having tray 70 rotably mounted on base member 10.

The article 1 can be made of any suitable material such as, for example, wood, metal and plastic, the last mentioned being preferred.

Figure 5:
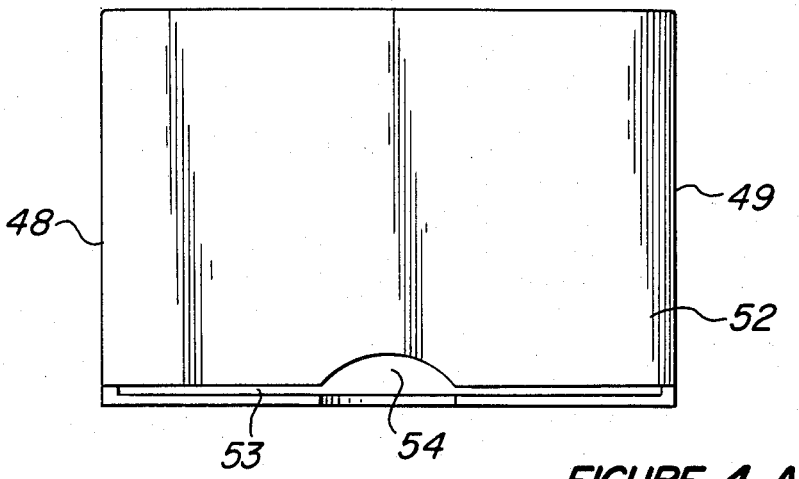
FIG. 5 is a perspective view of a die of the present invention showing arranged markings thereon.
Figure 5:
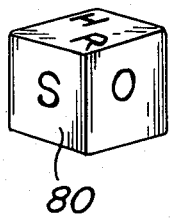
Figure 6:
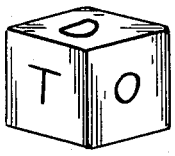
FIG. 6 is a perspective view of the die shown in FIG. 5 showing markings not seen in FIG. 5.

With reference to FIGS. 5 and 6, the set of baseball dice consists of three six-faced die members. Two of the faces 80 of each die container indicia representing "out". The remaining four faces contain indicia representing either a "single", "double", "triple" or "home run". It is possible, of course, for the dice to contain the actual words rather than indicia. The three dice are meant to be read in a specific order and are coded for identification purposes. In a preferred form, this coding is accomplished by making each die a different color. For example, the order can be red, white and blue.

Figure 7:
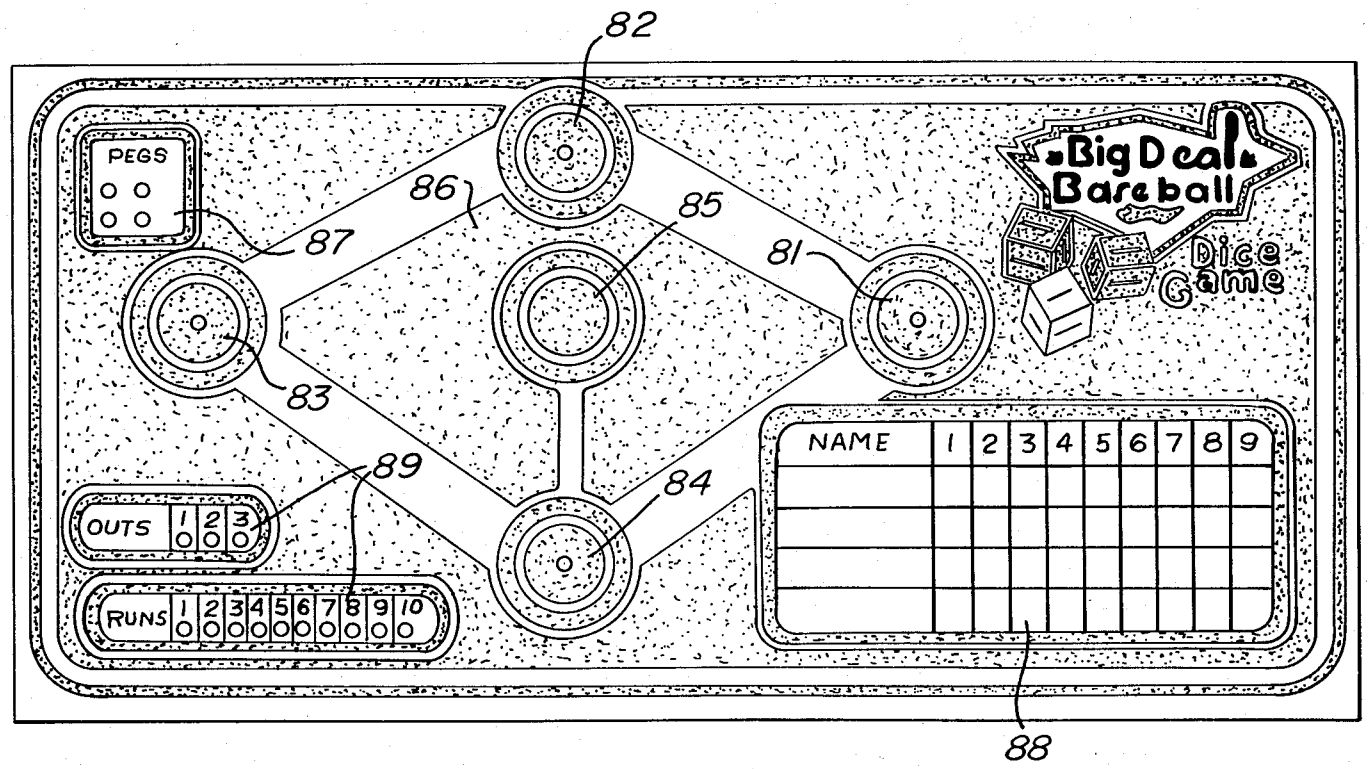
FIG. 7 is a perspective view of the scoreboard.

A baseball type scoreboard, such as is illustrated generally in FIG. 7, can be used in game play. The scoreboard features of baseball diamond comprising first, second and third bases, 81, 82, 83, home plate 84, a pitcher's mound 85, and an infield, 86. The scoreboard further contains indicia 87 which can be affixed to the bases to indicate runners on the bases, a scorecard 88, listing the runs scored by each player during a nine-inning game and indicators 89, indicating the number of outs and runs scored while an inning is in progress. The scorecard can be made from a sheet of plastic that can be marked with a felt-tip pen or a crayon-type pencil which is readily erasable after use and which is affixed to the surface of the scoreboard.

According to the method of the present invention, trading cards of at least one player are removed from storage compartment 12 of article 1 for storing and dispensing cards. The cards are made accessible by moving tray 30 from the closed position, as shown in FIG. 2, to the play position, as shown in FIG. 3. The trading cards are placed on the surface of base wall 42 from which they are dispensed through slot 53, as required.

In preferred form, each player carries out the above steps with his own article and trading cards, and the cards are dispensed from each article in turn.

Instead of using the dice to determine the number and recipient of the dispensed trading cards, players can use ordinary dice, playing cards, penalty and reward cards which contain instruction respecting the number of trading cards to be dispensed from the article and the recipients, cards showing the teams of professional sports figures shown on the trading cards, and cards showing baseball plays (outs, hits, and walks).

The examples that follow illustrate how players can use the article in combination with the dice, dice and scoreboard, and various substitutes for the dice.

In all of the examples, except for Examples 10 and 12 to 14, the initial steps of the method have been carried out and the cards are ready to be dispensed from the article 1.

EXAMPLE 1

This example illustrates how players can acquire trading cards using the article and dice labeled with baseball game plays.

Each player rolls the dice until three outs have been recorded, which completes that player's inning. Runs are scored in accordance with baseball rules except that for a single, double or triple, a run scores only if the bases are loaded. Each run scored by a player results in the other players dispensing one card to the player. Any player rolling three outs in one roll of the dice dispenses ten cards to a common pot. Any player who does not score a run in his inning dispenses five cards to the pot. Any player rolling three home runs in a single roll wins the pot. Any player rolling three singles, doubles or triples in a single roll wins a specified portion of the pot. Alternatively, the pot can be acquired by the player scoring the most runs in an inning or in a nine inning game.

In a preferred form, the players use the scoreboard to keep a running tally of runs scored, outs, and runners on base during an inning and the total runs scored by each player in a completed inning, and on the basis of those results trading cards are dispensed to one or more players.

EXAMPLES 2–9

Examples 2–3 use trading cards illustrating professional sports figures in team sports.

A stack of trading cards is placed on the base wall 42 of the dispensing tray 30 and one card is dispensed by each player in turn. The final player in the turn tries to match the team shown on the card with the team shown on the cards dispensed earlier in that turn and acquires all matching cards. All unmatched cards are placed in a pot, which is acquired by the final player who receives a card matching the sports figure on a card dispensed earlier in that turn. The opportunity to be the final player is rotated.

As an alternative, cards are dispensed by each player in turn and given to a common pot unless the card matches a card in the pot in some predetermined way (i.e., playing position). The player having the matching card acquires the pot. The pot can be increased by having each player dispense a number of cards to it initially.

In Examples 4–6, trading cards having numbers of two or more digits are used.

Cards are dispensed by each player in turn and given to a pot if the number varies by more than ten from that on the previous card dispensed. If the number varies by ten or less, that recipient acquires the pot.

As an alternative, each player first dispenses cards to a pot. Cards are dispensed by players as before and given to the pot until the number on the card is within 5 of the number on the previous card dispensed, whereupon the recipient acquires the pot.

The number spread used in these examples can be changed to a higher or lower number, depending upon the range of numbers on the cards being used.

As a further alternative, cards are dispensed to players for a predetermined number of turns with the player receiving the card with the highest number acquiring all of the cards dispensed.

In Example 7, trading cards of an individual are used. Cards are dispensed to players in turn and given to a pot unless the first initial of the name on the card matches that initial of the name on the previous card, whereupon the recipient acquires the pot. As an alternative, the initials of both names can be used.

In Examples 8–9 any of the above kinds of trading cards can be used.

The players choose a subject found on the trading cards dispensed (i.e., playing position, sports figures, numbers). Each player tries to guess the correct listing for that subject on the previous card dispensed.

For a correct guess, a player would acquire a predetermined number of cards from each of the other players and for an incorrect guess, the player would dispense one card to each of the other players. Alternatively, players making incorrect guesses could give a card to the pot acquired by the player making a correct guess.

EXAMPLE 10

The following example illustrates how players can use the article in combination with cards illustrating baseball game plays (outs, hits, and walks) to acquire trading cards.

Each player gives a selected number of trading cards to a pot. The illustrated cards are dispensed to a player until he receives cards signifying three outs, which completes that player's inning. Runs are scored from cards showing hits and walks as in baseball. Each run scored by a player results in the other players giving one card to the player. Any player not scoring a run in his inning gives five cards to a common pot which is acquired by the player scoring the most runs in the game.

EXAMPLES 11–12

The following examples illustrate how players can use the article in combination with cards illustrating sports teams to acquire trading cards illustrating sports figures shown on the team cards.

A team is selected, then a trading card is dispensed to each player who loses it to a common pot, unless the team of the sports figure shown on the trading card and the team card match, whereupon the player with the matching card acquires the cards in the pot.

As an alternative, team cards are dispensed to each player, with players in turn trying to guess the team shown on the next team card dispensed. A player selecting the wrong team gives one trading card to all other players. The other players give ten trading cards to a player selecting the right team. Alternatively, a player selecting the wrong team could give one trading card to the common pot with the player selecting the right team acquiring all of the cards in the pot.

EXAMPLES 13–14

The following examples illustrate how players can use the article in combination with playing cards to acquire trading cards.

Each player antes up a selected number of trading cards to a pot. Playing cards are dispensed from the article to each player in turn according to the rules of an agreed-upon card game, such as Poker or Black Jack.

The card game can be played for the trading cards in the pot, or additional trading cards can be added to the pot at selected intervals during the game. The player with the winning hand according to the rules of the card game acquires the pot. The players will alternate as dealer in card games in which a dealer is required.

EXAMPLES 15–18

The following examples illustrate how players can use the article in combination with ordinary dice to acquire trading cards.

Each player tries rolling two dice to obtain in sequence numbers from 1 to 12 and 12 back to 1, using the results appearing on one die or both dice. If successful in rolling the next number needed, a player continues, otherwise players roll in turn. After completing a turn, a player dispenses one card to a pot. Rolling a double is equivalent to rolling the next number needed in the sequence, except that the player must dispense three cards to the pot. Rolling a second consecutive double results in the player advancing two numbers in the sequence, dispensing ten cards to the pot, and rolling the dice again. Rolling a third consecutive double results in the player starting over at one. The player completing the sequence first wins the pot.

As a variation, the players dispense a predetermined number of trading cards to the pot. A player acquires five cards from the pot for rolling a 7 or 11 and dispenses five cards to the pot on rolling a 2, 3, or 12. For rolling a 5 or 9, the player dispenses that number of cards to the pot. On rolling an even number other than a double, the player acquires that number of cards from the pot. On rolling a double 1 or 6, the player dispenses five cards to the pot and for other doubles dispenses the number shown on the dice. Any player rolling a double continues. For a second consecutive double, the player acquires half of the pot and continues. For a third consecutive double, the player takes the remaining portion of the pot.

In a further example, the players again dispense cards to establish a common pot and roll the dice in turn. A player acquires a predetermined number of cards from the pot if the number rolled is greater than 7 and dispenses a predetermined number of cards to the pot if the number is under 7. For a 7, a player dispenses a predetermined number of cards to each of the other players. For a double, the player dispenses a number of cards equal to the number on the dice to the pot and continues. For a second consecutive double, the player takes one-half of the pot and continues. For a third consecutive double, the player acquires the remaining cards in the pot.

In an example, using also trading cards having numbers, a player rolls the dice and each of the players dispenses one card. The player rolling the dice acquires the odd or even numbered dispensed cards, depending upon whether the number on the dice was odd or even, with the remaining cards given to a common pot. The players roll in turn with the same outcome, except that a player rolling a double acquires all of the cards in the pot.

EXAMPLE 19

The following example illustrates how players can use the article in combination with penalty and reward cards and two ordinary dice to acquire trading cards. Each player rolls the dice in turn. A player rolling an odd number draws a penalty card which results in his dispensing trading cards to the other players or to a pot. A player rolling a double dispenses five trading cards to the pot and continues. For a second consecutive double, the player dispenses ten cards to the pot and continues. For a third consecutive double, the player acquires the cards in the pot. A player who rolls an even number that is not a double draws a reward card which results in his acquiring trading cards from the pot or from other players.

While the invention has been described hereinabove in terms of specific embodiments and a number of examples, the invention itself is not limited thereto but rather comprehends all modifications of and departures from those embodiments properly falling within the spirit and scope of the appended claims.

I claim:

1. An article for storing and dispensing trading cards comprising: a base member which includes a trading card storage compartment and support means; a card dispensing tray which includes a base wall and which is associated with said base member and is movable relative thereto to a closed position in which said compartment is covered by said base wall and to a play position, the base wall of said tray in said play position being supported on said support means; said support means and said base wall thereon being inclined downwardly with respect to said base member; said tray in said play position having an upstanding wall adapted to support a card stack position on said inclined base wall; and slot means positioned between said base wall and said upstanding wall from which a card can be dispensed.

2. An article according to claim 1 wherein said base wall includes a cut-out portion shaped like the end of a finger for providing finger access to the bottom card of a card stack that may be positioned on said inclined base wall.

3. An article according to claim 1 wherein said upstanding wall includes an arcuately shaped cut-out portion.

4. An article according to claim 1 wherein said compartment is defined by an end wall, two upstanding side walls and a partition, each of which extend from said base member, and wherein said tray in said play position includes two upstanding side walls which extend from said base wall, the dimensions of said side walls and upstanding wall of said tray being such as to permit their overlapping the end wall and side walls of said compartment when said tray is in said closed position.

5. An article according to claim 4 wherein each of said side walls defining said compartment includes a hinge-receiving member and wherein said base wall includes a neck portion, each side of which includes a hinge member, each engaging one of said hinge-receiving members to provide for pivotal movement of said tray from said closed to said play position.

6. A method by which players can acquire trading cards from each other by utilizing an article having a trading card storage compartment and a movable dispensing tray which also functions as a cover for said compartment, and dice having indicia, in which players carry out the steps of:

(A) storing trading cards in said storage compartment which is covered by said tray;

(B) uncovering said compartment, thereby providing access to said cards, by moving said tray to a play position;

(C) removing cards from said storage compartment and placing them on said tray;

(D) rolling said dice; and (E) depending on the indicia appearing on the dice, dispensing a card from said tray to a player or to a common pot for subsequent acquisition by a player.

7. A method according to claim 6 wherein said indicia represent baseball plays.

8. A method according to claim 7 including recording the game plays on a scoreboard having depicted thereon a baseball field and having means for recording said baseball plays and runs scored by each player during an inning, and runs scored during a nine inning game.

9. A method by which players can acquire trading cards from each other by utilizing an article having a trading card storage compartment and a movable dispensing tray which also functions as a cover for said compartment, said trading cards having indicia thereon, in which players carry out the steps of:

(A) storing trading cards in said storage compartment which is covered by said tray;

(B) uncovering said compartment, thereby providing access to said cards, by moving said tray to a play position;

(C) removing cards from said storage compartment and placing them on said tray; and (D) depending on the indicia appearing on a card dispensed from said tray, dispensing said card to a player or to a common pot for subsequent acquisition by a player.

* * * * *